US005262260A

United States Patent [19]

Yokoyama et al.

[11] Patent Number: 5,262,260

[45] Date of Patent: Nov. 16, 1993

[54] PHOTORECEPTOR CONTAINING CARRIER TRANSPORT WITH POLYSILANE AND PHENYLENE DIAMINE

[75] Inventors: Masaaki Yokoyama, Toyonaka; Kenji Yokoyama, Mito, both of Japan

[73] Assignee: Toagosei Chemical Industry Co., Ltd., Tokyo, Japan

[21] Appl. No.: 876,983

[22] Filed: May 1, 1992

Related U.S. Application Data

[62] Division of Ser. No. 541,671, Jun. 21, 1990, Pat. No. 5,130,214.

[30] Foreign Application Priority Data

| | | | |
|---|---|---|---|
| Jun. 22, 1989 | [JP] | Japan | 1-158385 |
| Nov. 30, 1989 | [JP] | Japan | 1-308919 |
| Nov. 30, 1989 | [JP] | Japan | 1-308930 |

[51] Int. Cl.[5] ..... G03G 5/047

[52] U.S. Cl. ..... 430/58; 430/59

[58] Field of Search ..... 430/58, 59

[56] References Cited

U.S. PATENT DOCUMENTS

| | | | |
|---|---|---|---|
| 4,265,990 | 5/1981 | Stolka et al. | 430/59 |
| 4,618,551 | 10/1986 | Stolka et al. | 430/58 |
| 4,758,488 | 7/1988 | Johnson et al. | 430/59 |
| 5,004,662 | 4/1991 | Mutoh et al. | 430/59 |
| 5,087,544 | 2/1992 | Muto et al. | 430/59 X |
| 5,166,016 | 11/1992 | Badesha et al. | 430/58 X |

*Primary Examiner*—Roland Martin

*Attorney, Agent, or Firm*—Browdy and Neimark

[57] ABSTRACT

Disclosed is a method for producing an electro-photographic photoreceptor capable of repeated copying without one imagewise exposure for every one copying and which is superior in stability, sensitivity, resolution and tone reproduction. This method comprises converting to an insulator, by irradiation with energy ray, any selected area of a surface of an electrophotographic photoreceptor comprising a conductive substrate, a carrier generation layer and a carrier transport layer composed mainly of a compound which is converted to an insulator by irradiation with energy ray.

7 Claims, 3 Drawing Sheets

PHOTORECEPTOR CONTAINING CARRIER TRANSPORT WITH POLYSILANE AND PHENYLENE DIAMINE

This is a division of application Ser. No. 07/541,671 filed Jun. 21, 1990, now U.S. Pat. No. 5,130,214.

BACKGROUND OF THE INVENTION

1. Field of the Invention

The present invention relates to a method for producing an electrophotographic photoreceptor and an apparatus used therefor. In particular, it relates to a method for producing an electrophotographic photoreceptor for obtaining electrophotographs utilizing the phenomenon that any selected area which has been converted to an insulator always maintains its pattern, and an apparatus used therefor. More particularly, it relates to a method for producing an electrophotographic photoreceptor which makes it possible to carry out copying repeatedly without one imagewise exposure for every one copying by simple steps of converting any selected area of a photoreceptor to an insulator, converting the pattern of this area, namely, the pattern formed by the insulator to electrostatic image, and utilizing this electrostatic image for copying, and to an apparatus used therefor.

2. Related Art Statement

Electrophotography is a technique which comprises exposing imagewise a selected partial area of the surface of photoreceptor with visible light to retain electrical charges in only unexposed area (charged area), carrying out development by allowing colorant (toner) to adhere to the charged area, transferring the colorant (toner) adhering to the charged area to an image receiving medium such as paper or other materials to form a pattern represented by the selectively exposed area on an image receiving medium such as paper or the like.

Conventional electrophotographic techniques can be roughly classified to a technique utilizing electrostatic latent images (xerographic process, Carlson process), a technique utilizing persistent internal polarization state and a technique utilizing persistent conductivity state.

The respective techniques will be briefly explained.

(a) Technique utilizing electrostatic latent images:

This is a technique for obtaining copies by repeating a series of steps of charging-imagewise exposure (formation of electrostatic latent images)-development (attraction of colorant)-transfer-fixation, using a selenium plate (selenium drum). This technique requires one imagewise exposure for obtaining every one copy.

(b) Technique utilizing persistent internal polarization state:

This is a technique according to which a plate-like material comprising ZnS:CdS phosphor and anthracene which has been applied with electrical field on both sides is subjected to imagewise exposure and carriers from which charges are removed by the above exposure are trapped in traps present in the plate-like material comprising ZnS:CdS phosphor and anthracene, thereby to form internal polarization and this internal polarization is retained even after electrical field and exposure are removed and thus internal polarization latent images are formed utilizing this persistent internal polarization state and the internal polarization latent images are developed and then the developed latent images are transferred to paper or the like to obtain a copy.

(c) Technique utilizing persistent conductivity state:

This is a technique according to which a layered material comprising a photoconductive layer prepared by dispersing an inorganic photoconductor powder such as zinc oxide, cadmium sulfide or the like in a resin, a photoconductive layer prepared by dispersing an organic photoconductor powder such as leuco-malachite green in a resin, a photoconductive layer prepared by adding leuco-malachite green (LMG) to a poly-N-vinylcarbazole (PVK) 2,4,7-trinitrofluorenone (TNF) carrier transport complex type photoconductor, or a photoconductive layer prepared by adding a diazonium salt (DS) to a poly-N-vinylcarbazole (PVK) 2,4,7-trinitrofluorenone (TNF) carrier transport complex type photoconductor, a switching layer prepared by dispersing Cu.TCNQ complex in a polymer which is formed on the photoconductive layer, and a photoconductive layer comprising PVK.TeNF(2,4,5,7-tetranitrofluorenone)carrier transport complex photoconductor is irradiated with light or the like, whereby there occurs difference in conductivity between exposed area and unexposed area and this difference in conductivity persistently remains even after termination of exposure to form latent conductivity images, which are developed and transferred to paper or the like to obtain a copy.

Electrophotographic photoreceptors are media for transfer of pattern used in electrophotographic method in which difference in physical or chemical state occurs between exposed area and unexposed area upon irradiation with light and correspond to the selenium plate (selenium drum), the plate-like material comprising ZnS:CdS phosphor and anthracene, and the layered material comprising a photoconductive layer comprising PVK.TeNF (2,4,5,7-tetranitrofluorenone) carrier transport complex photoconductor or other photoconductive layer, a switching layer and a carrier generation layer in the above-mentioned techniques (a), (b) and (c).

Among the above three electrophotographies, xerographic method and Carlson method have no memorization property and require one imagewise exposure for every one copying.

On the other hand, the technique using persistent internal polarization state and the technique using persistent conductivity state both utilize memorizability of photoreceptor and so do not require one imagewise exposure for every one copying, but these are still in the stage of technical development and have the problems such as low stability, insufficient sensitivity and resolution and poor tone reproduction (realization of halftone is difficult and shade of color becomes extreme, resulting in only image of deep color or colorless image). Thus, further improvement in these respects has been desired.

Therefore, electrophotographic photoreceptors excellent in stability, sensitivity, resolution and tone reproduction and having memorizability have been strongly demanded.

SUMMARY OF THE INVENTION

The object of the present invention is to provide an electrophotographic photoreceptor superior in stability, sensitivity, resolution and tone reproduction and having memorizability.

The inventors have found that the above object can be attained by providing an electrophotographic photoreceptor comprising a conductive substrate, a carrier generation layer and a carrier transport layer wherein any selected area of the surface of the carrier transport layer is converted to an insulator by irradiation with energy ray. Thus, the present invention has been accomplished.

That is, the present invention relates to a method for producing an electrophotographic photoreceptor capable of repeated copying without one imagewise exposure for every one copying, characterized in that any selected area of the surface of an electrophotographic photoreceptor comprising a conductive substrate, a carrier generation layer and a carrier transport layer composed mainly of a compound capable of being converted to an insulator by irradiation with energy ray is converted to an insulator by irradiation with energy ray, and it also relates to an apparatus used for carrying out the method.

Furthermore, the present invention relates to a method for producing an electrophotographic photoreceptor capable of repeated copying without one imagewise exposure for every one copying, characterized in that any selected area of the surface of an electrophotographic photoreceptor comprising a conductive substrate, a carrier generation layer and a carrier transport layer composed mainly of a polysilane is converted to an insulator by irradiation with energy ray, and it also relates to an apparatus used for carrying out the method.

Particularly, the present invention relates to an electrophotographic photoreceptor capable of repeated copying without one imagewise exposure for every one copying, characterized in that any selected area of the surface of an electrophotographic photoreceptor comprising a conductive substrate, a carrier generation layer and a carrier transport layer composed mainly of a polysilane and a low-molecular compound having an ionization potential within the range of ±0.15 eV of that of polysilane (within the range of from the ionization potential of the polysilane plus 0.15 eV maximum to the ionization potential of the polysilane minus 0.15 eV minimum) is converted to an insulator by irradiation with energy ray, and it also relates to an apparatus used for carrying out the method.

Figure 1:
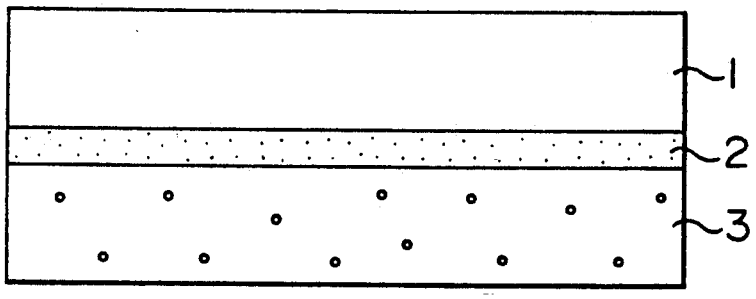
FIG. 1 is a cross-sectional view of an electrophotographic photoreceptor according to one embodiment of the present invention.

1 - - - Carrier transport layer
2 - - - Carrier generation layer
3 - - - Conductive substrate
4 - - - Ultraviolet ray
5 - - - Area converted to insulator
6 - - - Test chart for electrophotography
7 - - - Visible light
8 - - - Colorant (toner)
9 - - - Image receiving medium (paper)
10 - - - Corona discharge apparatus

DETAILED DESCRIPTION OF THE INVENTION

As the compounds which constitute carrier transport layer of the electrophotographic photoreceptor of the present invention, mention may be made of, for example, polysilanes, polyvinylcarbazoles, amine compounds, hydrazone derivatives, stilbenes, and pyrazoline derivatives.

It is known in U.S. Pat. No. 4,618,551 to use polysilanes as carrier transport layer of electrophotographic photoreceptors and polysilanes such as homopolymers, copolymers or terpolymers of various silanes which are mentioned in the above U.S. Patent may also be used in the present invention.

As mentioned in the above U.S. patent, the polysilanes have the following skeleton:

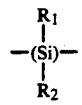

wherein $R_1$ and $R_2$ each represents an alkyl group, an aryl group, a substituted alkyl group, a substituted aryl group, an alkoxy group, or the like.

The polysilanes may be either random copolymers or terpolymers, or block copolymers or terpolymers.

Polysilanes used in the present invention preferably are of a weight-average molecular weight of from 1,000 to 2,000,000.

Examples of alkyl groups represented by $R_1$ or $R_2$ in the above skeleton include those which are linear or branched of 1-24 carbon atoms, preferably 1-8 carbon atoms, inclusive of methyl, ethyl, propyl, butyl, amyl, hexyl, octyl, nonyl, decyl, pentadecyl, stearyl; and unsaturated alkyl groups inclusive of allyl group. Specific preferred alkyl groups are methyl, ethyl, propyl and butyl. Aryl groups are preferably those of 6-24 carbon atoms, inclusive of phenyl, naphthyl, anthryl, and the like. These alkyl and aryl groups may have alkyl, aryl, halogen, nitro, amino, alkoxy, cyano and other substituents.

Examples of alkoxy groups include those of 1-10 carbon atoms, such as methoxy, ethoxy, propoxy, butoxy, and other similar substituents.

Specific examples of polysilanes include those which have phenyl group, such as poly(methylphenyl)silane [Ip=5.62 eV], poly(methylphenylsilylene-co-dimethyl)-silane, poly(phenylethyl)silane, poly(p-tolylmethyl)-silane, and poly(diphenylsilylene-co-phenylmethyl)silane, poly(cyclohexylmethyl)silane [Ip=5.92 eV], poly(dimethyl)silane [Ip=5.73 eV], poly(tert-butylmethyl)-silane, poly(n-propylmethyl)silane [Ip=5.77 eV], poly(di-n-hexyl)silane [Ip=5.78 eV], poly(cyclotrimethylene)silane, poly(cyclotetramethylene)silane, poly(cyclopentamethylene)silane, poly(-di-t-butylsilylene-co-dimethyl)silane, poly(cyanoethylmethyl)silane, poly(2-acetoxyethylmethyl)silane, poly(2-carbomethoxyethylmethyl)silane and the like. Especially preferred are polysilanes having phenyl group. (Numerical value in [ ] above is ionization potential measured on the polysilanes prepared by the inventors.)

These polysilanes can be prepared by known processes. (See, for example, R. C. West. "Comprehensive Organic Chemistry", Vol. 2, Chapter 9.4, p. 365-387 (1982), edited by G. Wilkinson et al., Pergamon Press, New York).

Examples of low-molecular compounds other than polysilanes which are used as compounds constituting carrier transport layer of the electrophotographic photoreceptors of the present invention (hereinafter referred to as merely "low-molecular compound") are as follows:

(a) Amine compounds

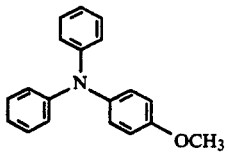
Ip = 5.70 eV
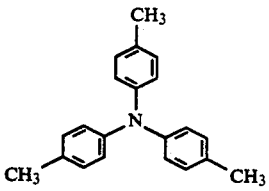
Ip = 5.7 eV
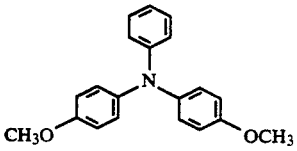
Ip = 5.58 eV
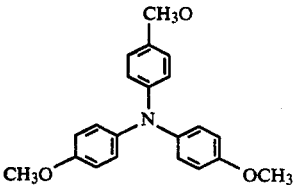
Ip = 5.45 eV
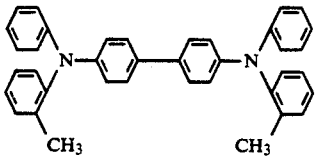
Ip = 5.42 eV
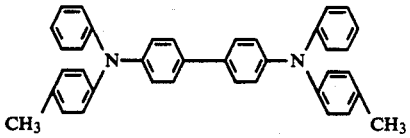
Ip = 5.52 eV
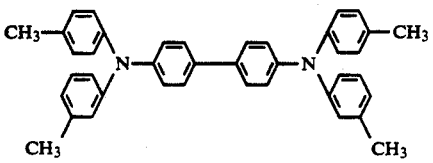
Ip = 5.54 eV
-continued
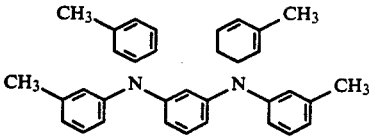
Ip = 5.63 eV
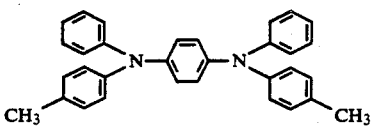
Ip = 5.44 eV
(b) Hydrazone derivatives
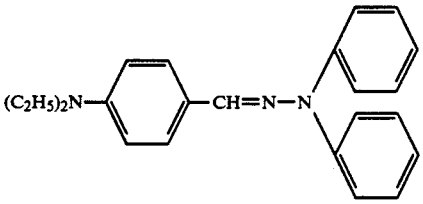
Ip = 5.23 eV
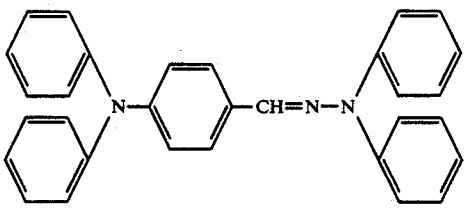
Ip =5.46 eV
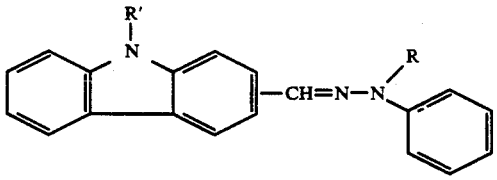
(c) Stilbenes
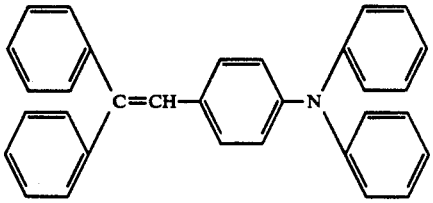
Ip =5.62 eV -continued

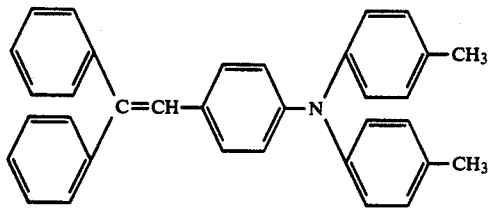

Ip =5.52 eV (d) Pyrazoline derivatives

For example, a pyrazoline derivative having the following formula.

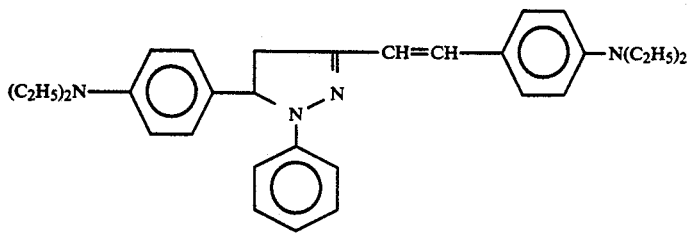

The carrier transport layer constituting the electrophotographic photoreceptor of the present invention may be mainly composed of at least one of the above polysilanes, low-molecular compounds, and polyvinylcarbazoles and preferred is one mainly composed of a polysilane and especially preferred is one mainly composed of a polysilane and a low-molecular compound having an ionization potential (Ip) within the range of ±0.15 eV, more preferably ±0.08 eV of ionization potential of the polysilane.

In the case of carrier transport layer mainly composed of polysilane and low-molecular compound having an ionization potential within the range of ±0.15 eV of ionization potential of the polysilane, Hole drift mobility of carrier is improved and besides, sensitivity increases and resolution and tone reproduction are also improved. Furthermore, since injection of carrier from carrier generation layer into carrier transport layer is improved, improvement of sensitivity can be attained even in combination with carrier generation layer comprising organic pigment from which carrier is injected into polysilane with difficulty.

Preferred polysilanes are those which have phenyl group such as poly(methylphenyl)silane (Ip=5.62 eV), and these exhibit the highest effect when used in combination with N,N,N',N'-tetrakis(3-methylphenyl)-1,3-phenylenediamine (hereinafter referred to as "PDA"; Ip=5.63 eV) or stilbene (Ip=5.62 eV).

Mixing ratio of polysilane and low-molecular compound when these are used in combination is such that low-molecular compound is preferably 1-70% by weight, more preferably 5-50% by weight, especially preferably 40-50% by weight based on the total amount of polysilane and low-molecular compound. If the amount is too small, Hole drift mobility is much the same as when only polysilane is used and improvement of sensitivity cannot be expected. If the amount is too large, low-molecular compound crystallizes with lapse of time and appears as particles on the surface and may cause inhibition of formation of good film and reduction in sensitivity and resolution.

Carrier transport layer may further contain 2,4,7-trinitro-9-fluorenone, m-dicyanobenzene, tetracyanoethylene and the like as auxiliary agents. Amount thereof is preferably 50% or less, more preferably 20% or less.

The carrier transport layer of the electrophotographic photoreceptor of the present invention can be formed by dissolving the above components in a solvent such as benzene and coating the solution by known method such as solvent coating method. Other methods such as laminating method, melt-extrusion method, dip coating method, and spraying method may also be employed.

Thickness of carrier transport layer of the electrophotographic photoreceptor is preferably 1-100 μm, especially 5-20 μm.

Various materials may be used for carrier generation layer of the electrophotographic photoreceptor of the present invention.

As materials for dye type carrier generation layer, mention may be made of, for example, phthalocyanine dyes such as metal-free phthalocyanine, copper phthalocyanine, vanadyl phthalocyanine, and titanyl phthalocyanine, azo dyes such as Sudan red, Dian Red, and Jenus Green B, quinone dyes such as Alcohol Yellow, pyrenequinone, Indanthrene Brilliant, and Violet RRP, quinocyanine dyes, indigo dyes such as indigo and thioindigo, bisbenzimidazole dyes such as Indo Fast Orange, and quinacridone dyes.

These may be used, if necessary, in admixture with resin binders such as polyester, polyvinyl butyral, polycarbonate, epoxy resin and polyhydroxy ether resin.

Materials for inorganic carrier generation layer include, for example, amorphous selenium, selenium alloy such as diarsenic triselenide, trigonal selenium, hydrogenated amorphous silicon, germanium, and silicon germanium alloy. Thickness of carrier generation layer 2 is not critical as far as the object of the present invention can be attained, but preferably is 0.1-5 μm.

As conductive substrate, there may be used, for example, conductive metals such as copper, aluminum and gold, glasses provided with conductivity by application of ITO film or the like (e.g., NESA glass), resin films provided with conductivity (e.g., polyimide, polyester), and paper provided with conductivity.

Laminate comprising these carrier transport layer, carrier generation layer and conductive substrate may be in any optional forms such as sheet, drum and the like.

Function of energy ray used for converting carrier transport layer to insulator is to bring about photochemical reaction by irradiation thereof to break bonds contained in the materials constituting the carrier transport layer or to realize crosslinking in the materials constituting the carrier transport layer. Therefore, energy ray used may be any energy ray which has energy sufficient to bring about the chemical reaction, and there may be used, for example, ultraviolet rays of 400–100 nm, more preferably 400–300 nm in wavelength, argon fluorine excimer laser beam, synchrotron radiation X-rays, corpuscular beams such as electron beam, carbon dioxide laser beam. Economically preferred is ultraviolet ray emitted from mercury lamp, but for printing of finer patterns, electron beam and excimer laser beam are preferred. When the above-mentioned materials constituting the carrier transport layer are irradiated with energy ray, an insulator layer is formed and thickness of the insulator layer can be changed depending on doses of irradiation of energy ray. Thus, tone can be reproduced in copied images.

Doses of energy ray for irradiating carrier transport layer depend on kinds and molecular weight of materials constituting the carrier transport layer, thickness of carrier transport layer, and the like. For example, when poly(methylphenyl)silane having a weight-average molecular weight of 5,000 is used and thickness of carrier transport layer is 6 μm and when a xenon lamp which emits ultraviolet ray of 300–400 nm is used, irradiated area can be converted to an insulator through the whole thickness by irradiation for about 22 minutes with energy density of 9.2 $mW/cm^2$. In other words, under the above conditions, energy required for converting the layer of 1 μm thick to insulator is about 0.2 $J/cm^2$.

The present invention utilizes the newly discovered fact that when any selected area of the surface of an electrophotographic photoreceptor having a carrier transport layer mainly composed of a compound converted to an insulator by irradiation with energy ray, especially a polysilane or the polysilane and a low-molecular compound having an ionization potential within the range of ±0.15 eV of ionization potential of the polysilane is irradiated with energy ray, for example, ultraviolet ray, the area irradiated with energy ray such as ultraviolet ray is converted to insulator and loses persistently (permanently) the function as a carrier transport layer. In more detail, any selected area of electrophotographic photoreceptor having a carrier transport layer mainly composed of substances converted to insulator by irradiation with energy ray such as the above-mentioned polysilane or the polysilane and the low-molecular compound having an ionization potential within the range of ±0.15 eV of ionization potential of the polysilane is converted to insulator by irradiation with energy ray such as ultraviolet ray. When negative charges are applied to the whole surface of the electrophotographic photoreceptor having partially the area which has been converted to insulator and which no longer functions as a carrier transport layer and then the charged surface is exposed to visible light, the area which has not been irradiated with energy ray functions as an ordinary carrier transport layer and loses charges while the area which has been irradiated with energy ray does not function as an ordinary carrier transport layer and negative charges remain only in this area and therefore, a pattern represented by the charges which remain in this exposed area is utilized as an electrostatic latent image.

A desired pattern is permanently memorized by the insulator area formed by irradiation with energy ray such as ultraviolet ray and an electrophotographic photoreceptor which permanently memorizes this desired pattern is subjected to the steps of negative charging-exposing of the whole surface to visible light or the like-developing (selective deposition of colorant)-transferring-fixing, whereby a plurality of copies carrying the desired pattern can be produced.

The copy can be easily reversed to either negative type or positive type by subjecting it to conventional reversal development such as application of bias voltage and the like.

The electrophotographic photoreceptor of the present invention is a layered photoreceptor comprising a conductive substrate, a carrier generation layer provided on the substrate, and, provided on this carrier generation layer, a carrier transport layer mainly composed of a compound capable of being converted to an insulator by irradiation with energy ray, especially, a polysilane, or the polysilane and a low-molecular compound having an ionization potential within the range of ±0.15 eV of that of said polysilane. Therefore, only a partial area of this electrophotographic photoreceptor can be converted to an insulator by irradiating only this partial area with energy ray. When the surface of the electrophotographic photoreceptor a part of which has been converted to insulator is charged with negative charges and then the whole surface is exposed to visible light, the negative charges remain only in the area irradiated with energy ray to form an electrostatic latent image and thus this partially exposed electrophotographic photoreceptor of the present invention can be utilized as a permanent printing master. In the electrophotographic photoreceptor of the present invention, additional writing can be made in the area which has not been irradiated with energy ray. Important characteristics of the electrophotographic photoreceptor of the present invention are that it is excellent in tone reproduction and can be applied to image having the lights and shades.

DESCRIPTION OF PREFERRED EMBODIMENTS

The electrophotographic photoreceptor of the present invention will be explained in more detail referring to the drawings.

EXAMPLE 1

Referring to FIG. 1:

A composition prepared by dispersing titanyl phthalocyanine (TiOPc) in polyvinyl butyral (PVB) at a weight ratio of 1:1 was coated at a thickness of 0.5 μm on aluminum substrate 3 to form carrier generation layer 2. Thereon was coated, by bar coating method, a solution prepared by dissolving in benzene a polysilane having a weight-average molecular weight of 10,000 obtained by polymerization of methylphenyldichlorosilane as a starting material using metallic sodium in toluene by the process of West et al and then the coat was dried to form carrier transport layer 1 of 6 μm thick. Thus, a layered electrophotographic photoreceptor comprising these three layers was produced. The resulting electrophotographic photoreceptor (before exposure) had a Hole drift mobility of $10^{-4}$ $cm^2/V \cdot s$ and a sensitivity of 0.029 $cm^2/\mu J$.

The Hole drift mobility was measured by usual Time-of-Flight (TOF) method with dye laser (633 nm) excitation and sensitivity was measured by EPA-8100 of Kawaguchi Electric Co.

Figure 2:
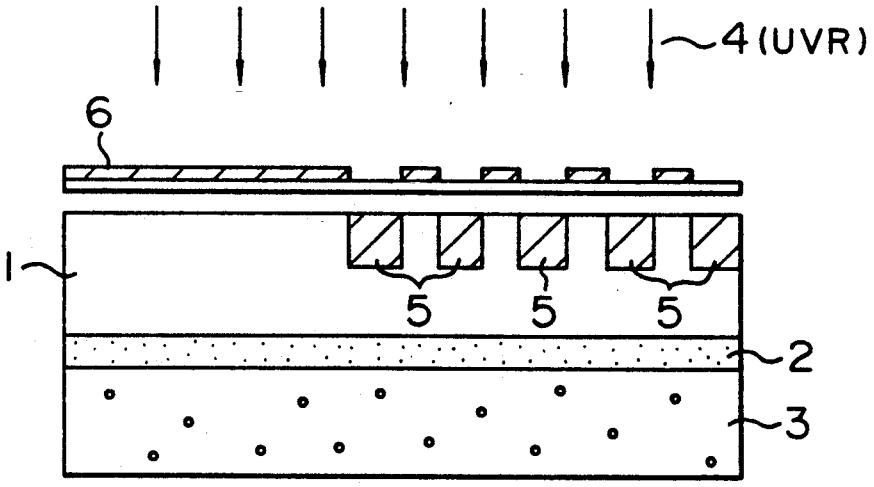
FIGS. 2-7 represent flow sheets for carrying out printing using an electrophotographic photoreceptor according to one embodiment of the present invention.

Referring to FIG. 2:

Electrophotographic test chart 6 (with black pattern and transparent background) as a mask was put on the thus obtained layered photoreceptor and the photoreceptor was subjected to imagewise exposure by irradiating through the mask with ultraviolet ray 4 (300–400 nm) with an irradiation energy of 9.2 mW/cm$^2$ from mercury lamp for 60 minutes, thereby to convert the area irradiated with ultraviolet ray to insulator 5.

Then, printing was carried out using conventional laser printer. Detailed explanation will be made on the steps of printing.

Figure 3:
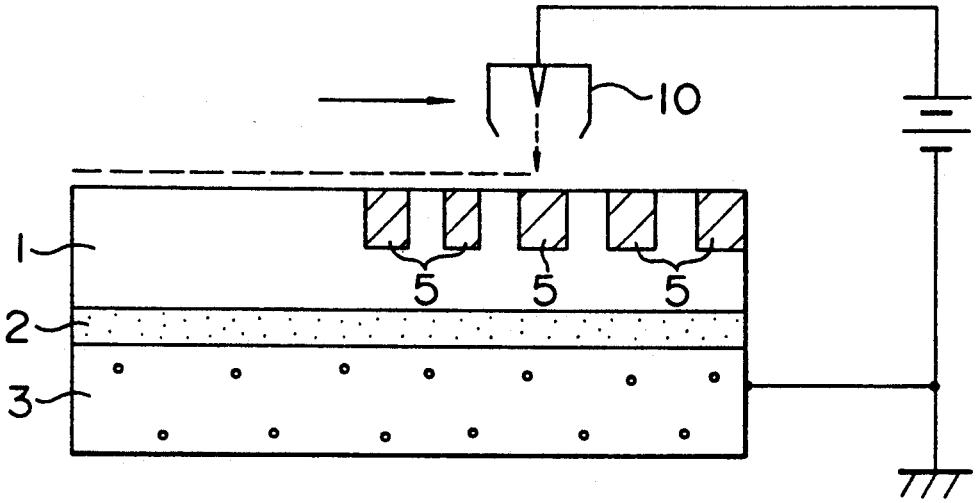

Referring to FIG. 3:

The whole upper surface of carrier transport layer 3 was negatively charged by corona discharge apparatus 10.

Figure 4:
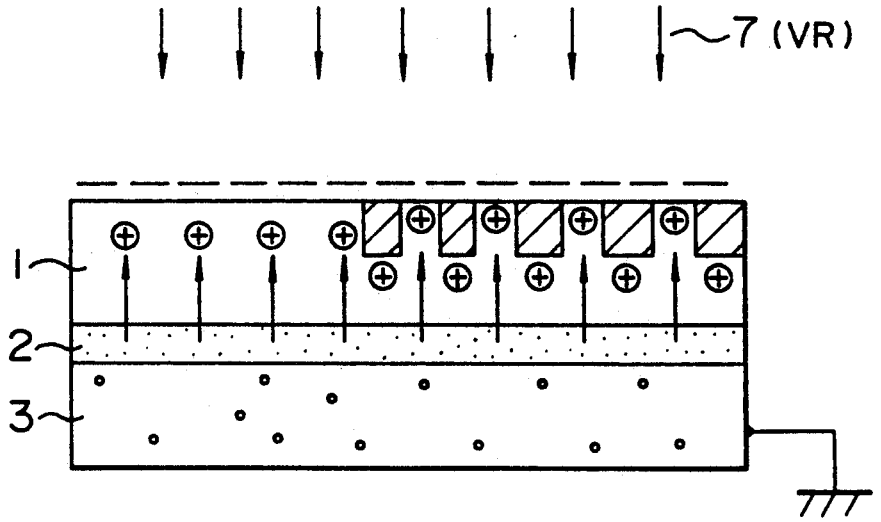
Figure 5:
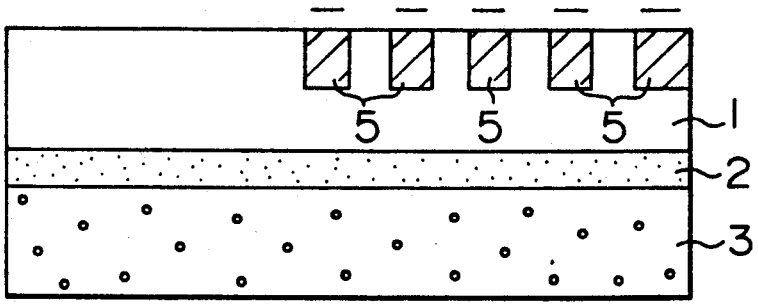

Referring to FIGS. 4 and 5:

When the whole upper surface of carrier transport layer 3 was exposed to visible light 7, positive charges were generated from carrier generation layer 2. The positive charges moved upwardly in carrier generation layer and bonded to the above-mentioned negative charges and the negative charges dissipated in the area which had not been irradiated with ultraviolet ray. However, the positive charges were not able to bond to negative charges in the area which had been irradiated with ultraviolet ray due to blocking by insulator 5 and hence, the negative charges remained in this area.

Figure 6:
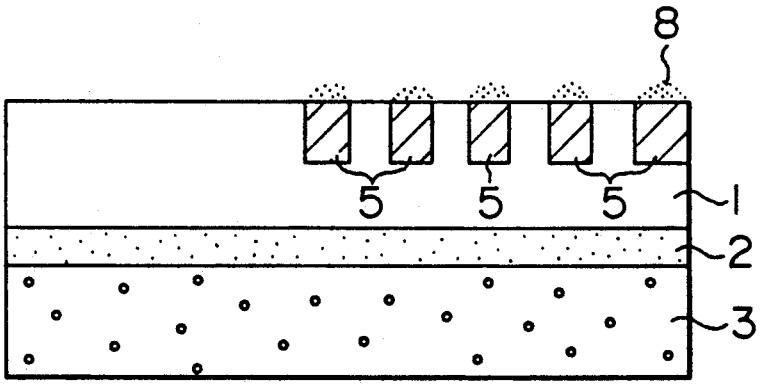

Referring to FIG. 6:

When a colorant such as toner was sprayed on the carrier transport layer 3, the colorant such as toner was deposited only on the area in which negative charges remained (on insulator 5) to perform development.

Figure 7:
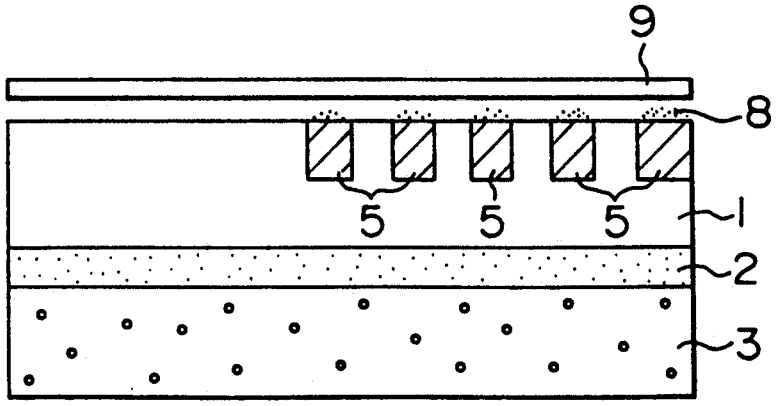

Referring to FIG. 7:

Then, an image receiving medium such as paper was superposed on the carrier transport layer 3 which carried colorant such as toner only on the developed area which had been irradiated with ultraviolet ray and the colorant 8 such as toner was transferred onto the image receiving medium and fixed to obtain a copy.

In this way, more than 100 copies carrying clear negative type images were produced.

When this negative type images were subjected to reversal development, clear positive type images were obtained.

EXAMPLE 2

Procedure of Example 1 was repeated except that a polysilane (Ip=5.62 eV) having a weight-average molecular weight of 5,000 was used for carrier transport layer 1 and nearly the same results as in Example 1 were obtained.

EXAMPLE 3

Electrophotographic photoreceptor was produced in the same manner as in Example 1 except that a mixture of the polysilane (Ip=5.62 eV) used in Example 1 and PDA (Ip=5.63 eV) added in an amount of 50% by weight based on the total amount of the polysilane and PDA was used as a material for carrier transport layer 1. The resulting photoreceptor (before exposure) had a Hole drift mobility of $10^{-3}$ cm$^2$/V·s, which was higher by one figure than that of the photoreceptor of Example 1.

Furthermore, light decay of surface potential of the photoreceptor was measured by EPA-8100 of Kawaguchi Electric Co. to obtain 1.85 cm$^2$/μJ which indicated high sensitivity.

Copies were produced in the same manner as in Example 1 to obtain more than 100 copies carrying clear negative type images as in Example 1.

The negative images were subjected to reversal development to obtain clear positive type images.

EXAMPLE 4

Procedure of Example 3 was repeated except that a polysilane (Ip=5.62 eV) having a weight-average molecular weight of 5,000 was used as the material for carrier transport layer 1 and nearly the same results as in Example 3 were obtained.

EXAMPLE 5

An electrophotographic photoreceptor was produced in the same manner as in Example 3 except that the following azo compound was used as carrier generation layer 2. The resulting photoreceptor had a sensitivity of 0.45 cm$^2$/μJ and nearly the same results as in Example 3 were obtained in making of copies.

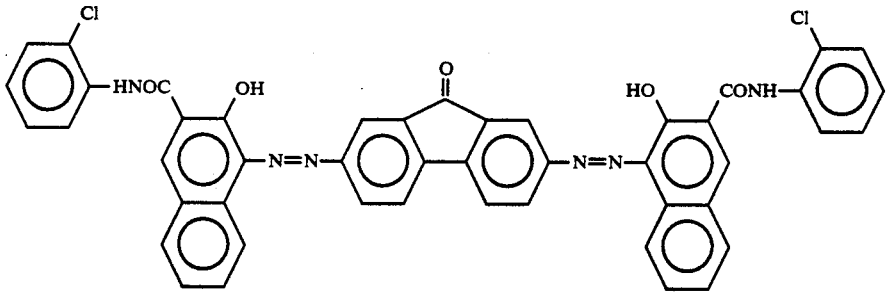

(Ip = 5.92 eV)

EXAMPLE 6

An electrophotographic photoreceptor was produced in the same manner as in Example 3 except that stilbene was used as the low-molecular compound. Nearly the same results as in Example 3 were obtained.

EXAMPLE 7

An electrophotographic photoreceptor was produced in the same manner as in Example 3 except that the following hydrazone derivative having an ionization potential of 5.38 eV was used as the low-molecular compound. The resulting photoreceptor (before exposure) had a Hole drift mobility of the level of $10^{-6}$ cm$^2$/V·s., 100 copies were able to be obtained, but development resulted in unclear images.

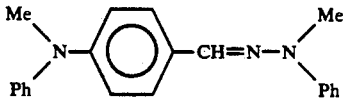

(Ip = 5.38 eV)

-continued (Me: methyl group, Ph: phenyl group)

What is claimed is:

1. An electrophotographic photoreceptor which comprises a conductive substrate, a carrier generation layer and a carrier transport layer, wherein said carrier transport layer is composed mainly of a polysilane and a compound which is N,N,N,N-tetrakis)methyl-phenyl)-1,3-phenylenediamine or a stilbene compound.

2. An electrophotographic photoreceptor according to claim 1 wherein the polysilane is poly(methyl-phenyl)silane.

3. An electrophotographic photoreceptor according to claim 1 wherein the amount of N,N,N,N-tetrakis(-methyl-phenyl)-1,3-phenylenediamine or the stilbene compound is 1-70% by weight based on the total weight of said amount and the amount of the polysilane.

4. An electrophotographic photoreceptor according to claim 1 wherein the amount of N,N,N,N-tetrakis(-methyl-phenyl)-1,3-phenylenediamine or the stilbene compound is 5-50% by weight based on the total weight of said amount and the amount of the polysilane.

5. An electrophotographic photoreceptor according to claim 1 wherein the amount of N,N,N,N-tetrakis(-methyl-phenyl)-1,3-phenylenediamine or the stilbene compound is 40-50% by weight based on the total weight of said amount and the amount of the polysilane.

6. An electrophotographic photoreceptor according to claim 1 wherein said compound is N,N,N,N-tetrakis(3-methylphenyl)-1,3-phenylenediamine.

7. An electrophotographic photoreceptor according to claim 1 wherein the stilbene compound is stilbene.

* * * * *